US008150279B2

(12) United States Patent
Nakabayashi

(10) Patent No.: US 8,150,279 B2
(45) Date of Patent: Apr. 3, 2012

(54) IMAGE FORMING APPARATUS WITH ENERGY ACCUMULATION DIAGNOSTICS AND STATE CORRECTION

(75) Inventor: Masahiro Nakabayashi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 12/222,982

(22) Filed: Aug. 21, 2008

(65) Prior Publication Data

US 2009/0060537 A1 Mar. 5, 2009

(30) Foreign Application Priority Data

Aug. 30, 2007 (JP) ..... 2007-224010

(51) Int. Cl.
*G03G 15/00* (2006.01)

(52) U.S. Cl. ..... 399/37; 399/43

(58) Field of Classification Search ..... 399/37, 399/9, 38, 43, 46

See application file for complete search history.

(56) References Cited

U.S. PATENT DOCUMENTS 4,466,074 A * 8/1984 Jindrick et al. ..... 702/176
4,739,367 A * 4/1988 Watanabe et al. ..... 399/111
2005/0158067 A1 * 7/2005 Kim et al. ..... 399/70

FOREIGN PATENT DOCUMENTS

JP 2004-133259 4/2004
JP 2006-178079 A 7/2006
JP 2007-094281 A 4/2007

* cited by examiner

*Primary Examiner* — David Porta
*Assistant Examiner* — Mark R Gaworecki
(74) *Attorney, Agent, or Firm* — Kubotera & Associates, LLC

(57) ABSTRACT

An image forming apparatus includes an image forming unit for forming an image using a consumable supply; a cover attached to the image forming unit; an energy accumulation unit for accumulating energy when the cover is closed; an energy initializing unit for initializing a level of the energy accumulated in the energy accumulation unit when the cover is opened; an energy detection unit for detecting whether the level of the energy accumulated in the energy accumulation unit is initialized; and a state correction unit for correcting a state of the image forming unit according to a detection result of the energy detection unit.

4 Claims, 10 Drawing Sheets

IMAGE FORMING APPARATUS WITH ENERGY ACCUMULATION DIAGNOSTICS AND STATE CORRECTION

BACKGROUND OF THE INVENTION AND RELATED ART STATEMENT

The present invention relates to an image forming apparatus.

In a conventional image forming device such as a printer, there has been known a configuration, in which a state of the image forming apparatus is corrected according to states of consumable supplies such as toner, a developing unit, and a transfer unit provided in the image forming apparatus. Each consumable supply such as a toner has a different property individually, so that it is necessary to correct the state of the image forming apparatus according to the state of the consumable supply whenever the consumable supply is replaced.

The correction process is performed when a user has an access to the consumable supply, for example, when a cover is opened and closed or the image forming apparatus is turned on from a power-off state during which an opening and a closing of the cover is not detected (refer to Patent Reference). Patent Reference: Japanese Patent Publication No. 2004-133259A In the conventional image forming apparatus described above, the correction process is performed upon turning on the image forming apparatus even after the user does not have an access to the consumable supply and the image forming apparatus is turned off. As described above, it is not possible to detect whether the user opens the cover and has an access to the consumable supply when the image forming apparatus is turned off. Accordingly, when the user turns on the image forming apparatus, the user cannot use the image forming apparatus until the correction process is completed.

In view of the problems described above, an object of the invention is to provide an image forming apparatus, in which it is possible to determine whether a correction process is necessary when the image forming apparatus is turned on, thereby improving operability of the image forming apparatus.

Further objects of the invention will be apparent from the following description of the invention.

SUMMARY OF THE INVENTION

In order to attain the objects described above, according to the present invention, an image forming apparatus includes an image forming unit for forming an image using a consumable supply; a cover attached to the image forming unit; an energy accumulation unit for accumulating energy when the cover is closed; an energy initializing unit for initializing a level of the energy accumulated in the energy accumulation unit when the cover is opened; an energy detection unit for detecting whether the level of the energy accumulated in the energy accumulation unit is initialized; and a state correction unit for correcting a state of the image forming unit according to a detection result of the energy detection unit.

With the configuration described above, the state correction unit corrects the state of the image forming unit when the level of the energy accumulated in the energy accumulation unit is initialized. In other words, in the image forming apparatus, the state thereof is corrected only when the cover is opened to initialize the level of the energy. Accordingly, in the image forming apparatus, it is possible to determine whether the cover is opened according to the level of the energy accumulated in the energy accumulation unit even when it is not possible to detect whether the cover is opened or closed such as the image forming apparatus is turned off.

As described above, according to the invention, it is possible to determine whether the correction process is necessary when the image forming apparatus is turned on, thereby improving operability of the image forming apparatus.

DETAILED DESCRIPTION OF THE PREFERRED EMBODIMENTS

Hereunder, embodiments of the present invention will be explained with reference to the accompanying drawings.

First Embodiment

A first embodiment of the present invention will be explained.

In the embodiment, an image forming apparatus includes a capacitor as an energy accumulation unit to accumulate energy according to an open/close state of a cover. When the cover is opened, the capacitor is connected to a switching element that is disposed between the comparator and the ground. With this configuration, the image forming apparatus discharges charges accumulated in the comparator to ground once the cover is opened while electric power is off. Then, the image forming apparatus determines whether the cover is opened/closed while the electric power is off according to a state of the charges accumulated in the capacitor upon starting up the image forming apparatus from the power-off state.

Figure 1:
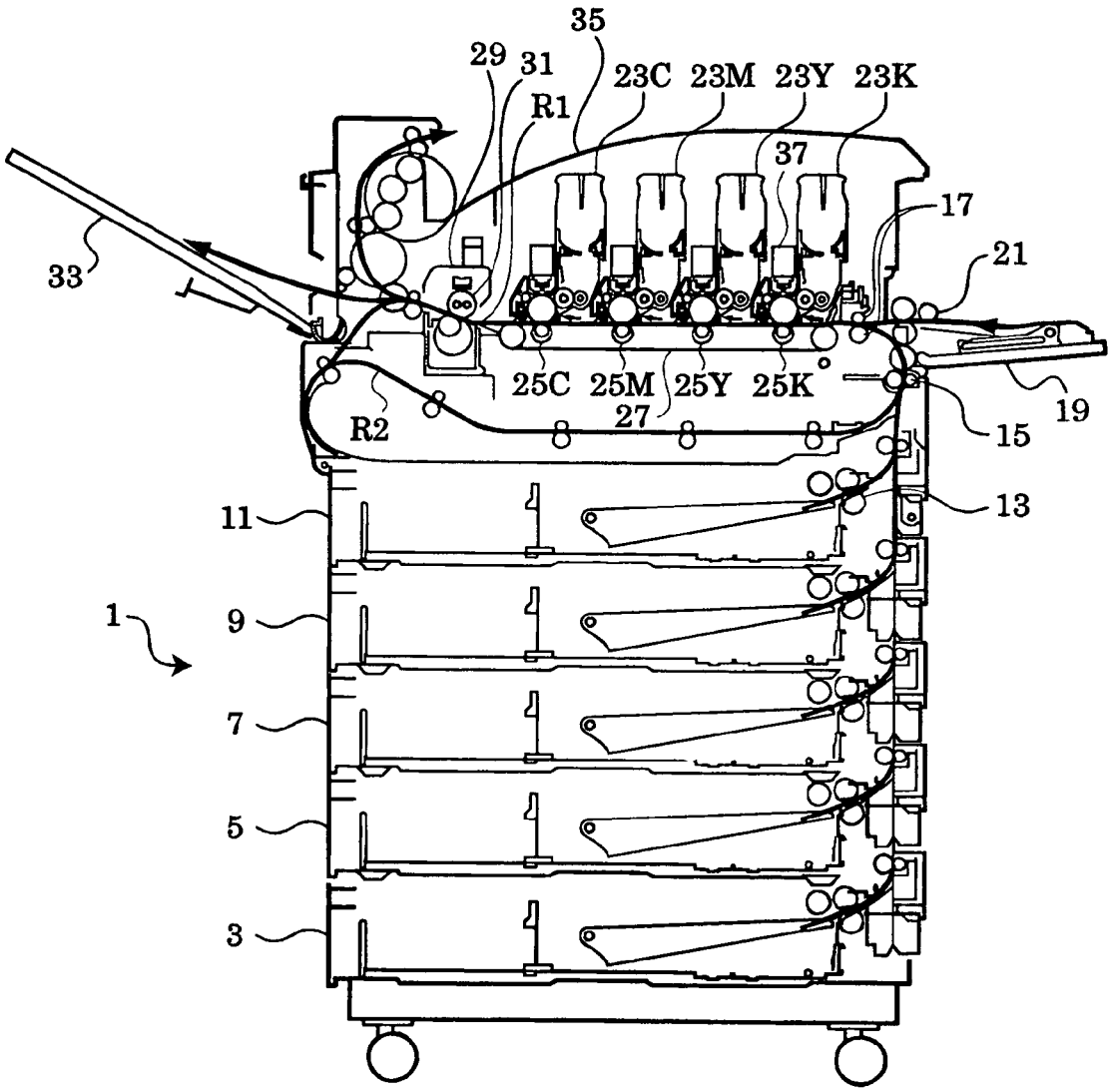
FIG. 1 is a schematic sectional view showing a printer according to a first embodiment of the present invention.

FIG. 1 is a schematic sectional view showing a printer 1 according to the first embodiment of the present invention. As shown in FIG. 1, the printer 1 includes a plurality of sheet cassettes 3, 5, 7, 9, and 11. A sheet is transported from one of the sheet cassettes 3, 5, 7, and 9, in which various types of sheets are placed, according to contents of print data input from an external device. The sheet cassettes 3, 5, 7, and 9 have a same configuration, and only the sheet cassette 11 will be explained as an example.

The sheet cassette 11 has a separation mechanism 13 that separates the sheets stacked therein and feeds the sheet. The separation mechanism 13 separates the sheet one by one with a driving force supplied thereto, so that the sheet is fed in a downstream direction of a medium convey path R1. After the sheet is fed in the downstream direction of the medium convey path R1, feed rollers 15 and 17 further transport the sheet to an image forming unit. In addition, the printer 1 has a multipurpose tray 19 as well as the sheet cassettes 3, 5, 7, 9, and 11. A hopping roller 21 transports a sheet placed in the multipurpose tray 19 to the medium convey path R1.

In the embodiment, the image forming unit includes developing units 23C, 23M, 23Y, and 23K. The developing units 23C, 23M, 23Y, and 23K form developer images corresponding to each color. After the developing unit 23C, 23M, 23Y, and 23K form the developer images, transfer rollers 25C, 25M, 25Y, and 25K transport the sheet to a conveyor belt 27, so that the developer images are successively transferred onto the sheet.

Thereafter, the developer images are transferred to the sheet, the sheet is conveyed to a fixing unit 29, which is disposed in the downstream direction of the medium convey path R1. The fixing unit 29 fixes the developer images transferred on the sheet through heat and a pressuring force of a fixing roller 31. The sheet ejected from the fixing unit 29 is ejected to either of ejecting sections, face-up stacker 33 or face-down stacker 35. When the input print data are related to duplex printing, the sheet ejected from the fixing unit 29 is conveyed to an upstream side of the developing units 23C, 23M, 23Y, and 23K via an sheet turn-over path R2.

Figure 2:
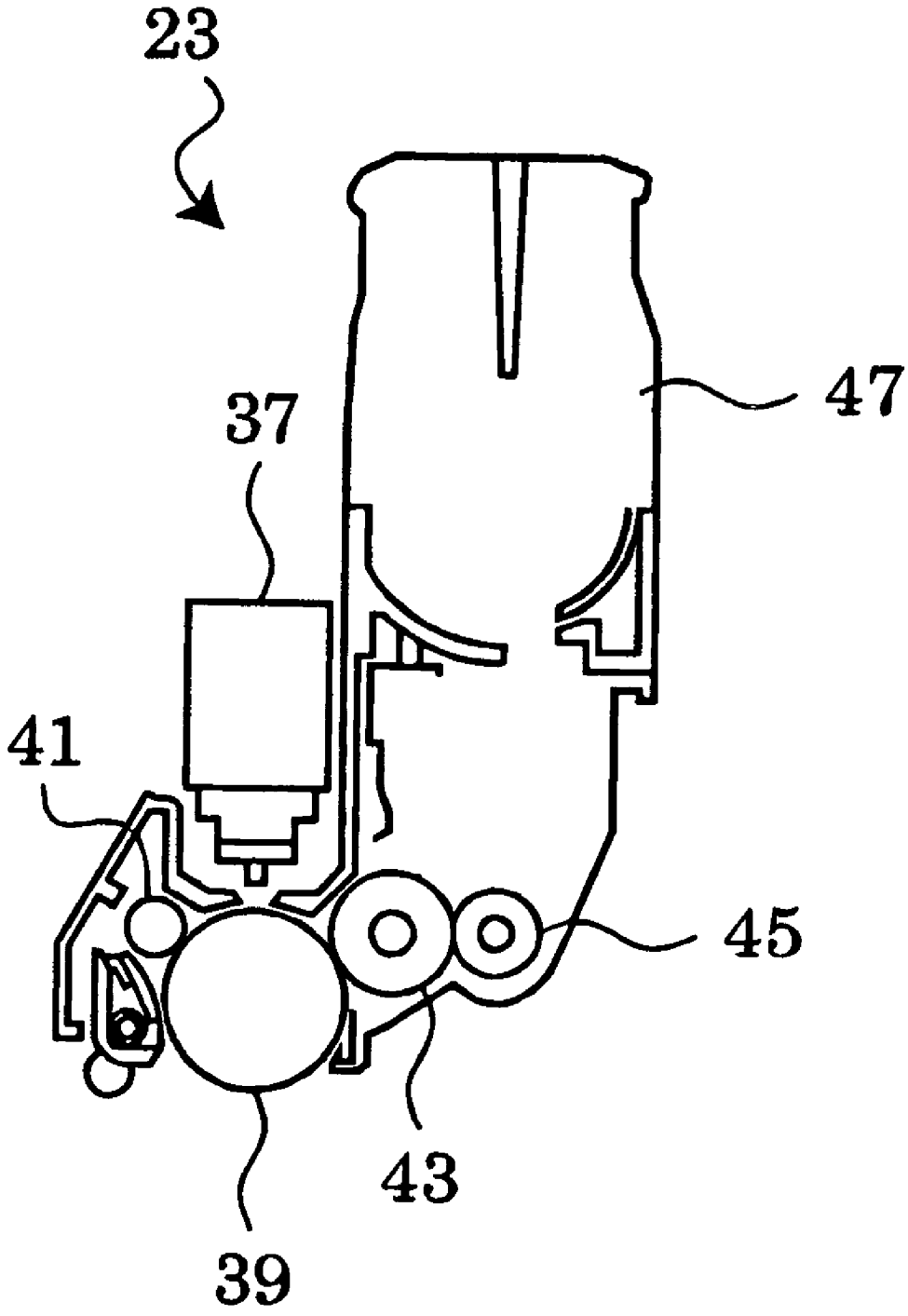
FIG. 2 is a schematic sectional view showing a developing unit of the printer according to the first embodiment of the present invention.

In the embodiment, the developing units 23C, 23M, 23Y, and 23K have a same configuration, and are referred to as a developing unit 23. FIG. 2 is a schematic sectional view showing the developing unit 23 of the printer 1 according to the first embodiment of the present invention.

As shown in FIG. 2, the developing unit 23 includes a photosensitive drum 39 to support a latent image thereon, which is exposed with an exposure unit 37; a charge roller 41 to uniformly charge an surface of the photosensitive drum 39; a developing roller 43 to adhere developer to the latent image; a supply roller 45 to supply developer to the developing roller 43; and a developer hopper 47 to hold developer therein.

Among the components of the developing unit 23, the photosensitive drum 39, the developing roller 43, and so on, for example, are consumable supplies that regularly require replacement after surfaces thereof are worn out in a continuous use. Similarly, the developer hopper 47 is also a consumable supply that requires replacement when no developer is therein. For replacing the consumable supplies, which are installed so as to be freely attached/detached, a user lifts the face-down stacker 35 so as to expose the developing unit 23, and accesses to the developing unit 23.

Figure 3:
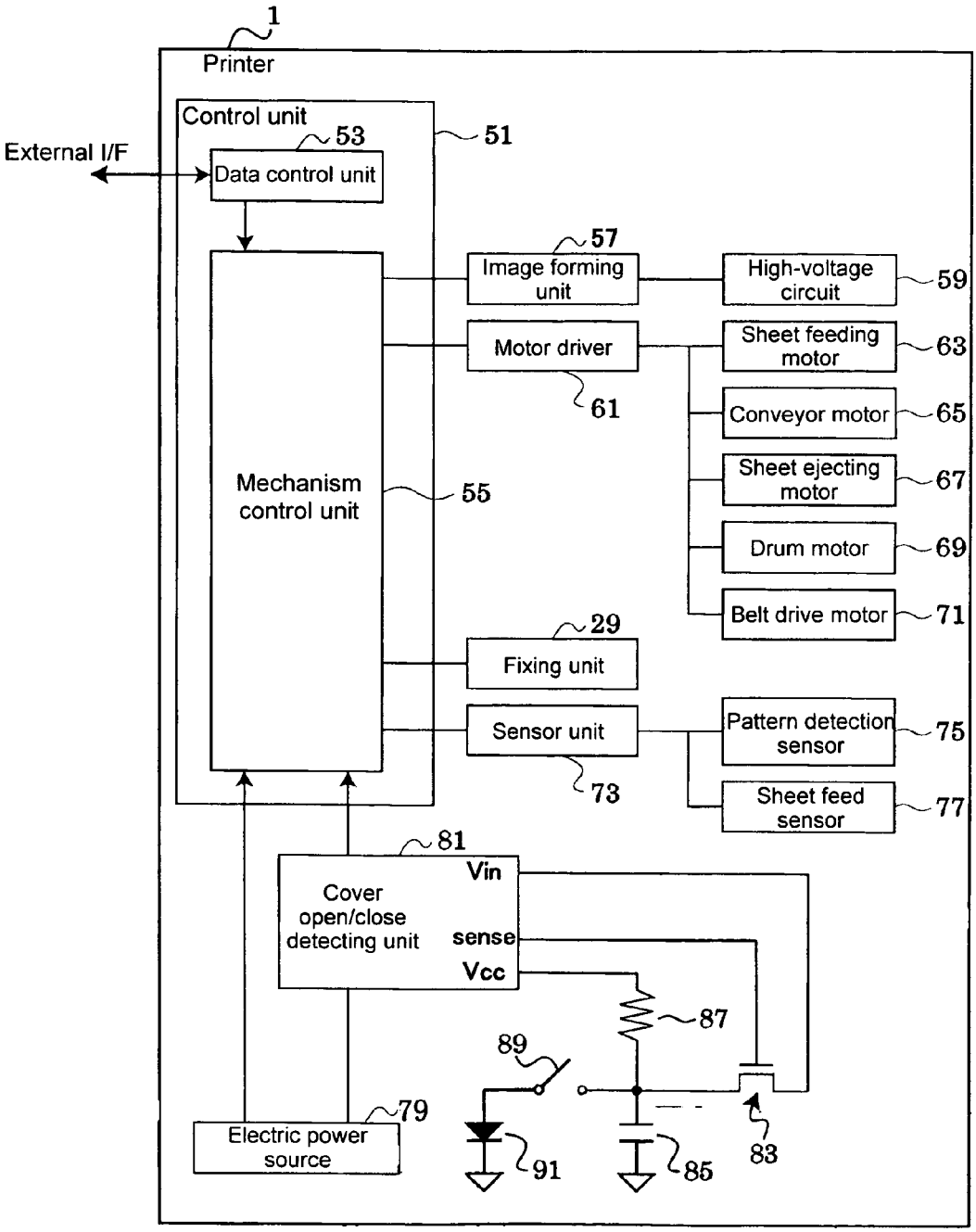
FIG. 3 is a block diagram of the printer according to the first embodiment of the present invention.

FIG. 3 is a block diagram of the printer 1 according to the first embodiment of the present invention. As shown in FIG. 3, the printer 1 further includes a control unit 51 to control each unit of the printer 1. The control unit 51 includes a data control unit 53 to process print data based on print data received via an outer interface, and a mechanism control unit 55 to control an operation of each unit based on a command from the data control unit 53.

The data control unit 53 stores the print data, analyzes the print data, and performs a process to expand the print data to printable image data. The data control unit 53 includes CPU (Central Processing Unit), RAM (Random Access Memory), ROM (Read Only Memory), etc. Then, the data control unit 53 provides the image data to the mechanism control unit 55.

The mechanism control unit 55 controls physical operations of each unit of the printer 1 based on the image data. More specifically, the mechanism control unit 55 controls an operation of an image forming unit 57 comprised of the developing unit 23 and the transfer roller 25, and a high-voltage circuit 59 to supply high-voltage electric power to the image forming unit 57, based on the image data. The image forming unit 57 and the high-voltage circuit 59 form the developer image on the sheet, and are controlled by the mechanism control unit 55.

In a series of the image forming process, the mechanism control unit 55 further controls a sheet feeding motor 63 to generate a driving force for feeding the sheet via a motor driver 61; a conveyor motor 65 to generate a driving force for conveying the sheet along the medium convey path R1 and the sheet turn-over path R2; a sheet ejecting motor 67 to generate a driving force for ejecting the sheet; a drum motor 69 to supply a driving force to a drum such as the photosensitive drum 39; and a belt drive motor 69 to feed a driving force to the conveyor belt 27.

In the embodiment, the mechanism control unit 55 further controls a fixing process of the fixing unit 29, and also retrieves detection results of a pattern detection sensor 75 and a sheet feed sensor 77 through a sensor unit 73. The mechanism control unit 55 is driven based on electric power supplied from an electric power source 79.

The printer 1 further includes a cover open/close detecting unit 81 to detect the open/close state of the face-down stacker 35, which works as a cover. The cover open/close detecting unit 81 detects an energy level of the capacitor 85 via a field effect transistor (hereinafter referred to as FET) 83 as an energy detecting unit connected to a terminal "sence", so that the open/close state of the face-down stacker 35 is detected while the power of the printer 1 is turned off.

In the embodiment, the cover open/close detecting unit 81 is connected to a source terminal of the FET 83 via a terminal Vin. The cover open/close detecting unit 81 determines whether the face-down stacker 35 is opened/closed while the power is turned on based on a variation in an electric potential input to the terminal Vin. In addition, the cover open/close detecting unit 81 is connected to a gate terminal of the FET 83 via the terminal "sence". Furthermore, the cover open/close detecting unit 81 feeds electric power to the capacitor 85 via a resistance 87.

In the embodiment, a terminal Vcc is connected to one end of a switch element 89 that drives in response to the open/close state of the face-down stacker 35. The cover open/close detecting unit 81 electrically connects terminals of the FET 83 and supplies a constant voltage to the capacitor 85 when the printer 1 is turned on.

The cover open/close detecting unit 81 detects an initial rise in an electric potential between the capacitor 85 and the resistance 87 based on a change in an electric potential input to the terminal Vin. When the energy level of the capacitor 85 exhibits an initial rise higher than a certain value, it is determined that the face-down stacker 35 is opened or a long period of time passed since the power of the printer 1 is turned off.

In the embodiment, the switch element 89 drives in response to the open/close state of the facedown stacker 35. More specifically, the switch terminal 89 connects one end of the capacitor 85 to ground via a diode 91 when the facedown stacker 35 is in the open state. Accordingly, the energy stored in the capacitor 85 is discharged towards ground. In other words, the switch element 89 works as an energy initializing unit to initialize the energy level accumulated in the capacitor 85 when the face-down stacker 35 is opened. When the facedown stacker 35 is in the close state, the switch terminal 89 electrically disconnects between one end of the capacitor 85 and ground.

In the embodiment, the pattern detecting sensor 75 detects a developer density of a test pattern formed on the conveyor belt 27, being controlled by the mechanism control unit 55. A test pattern detection result is used for a density correction process by the mechanism control unit 55. More specifically, the mechanism control unit 55 functions as a state correction unit to correct a density of an image.

Figure 4:
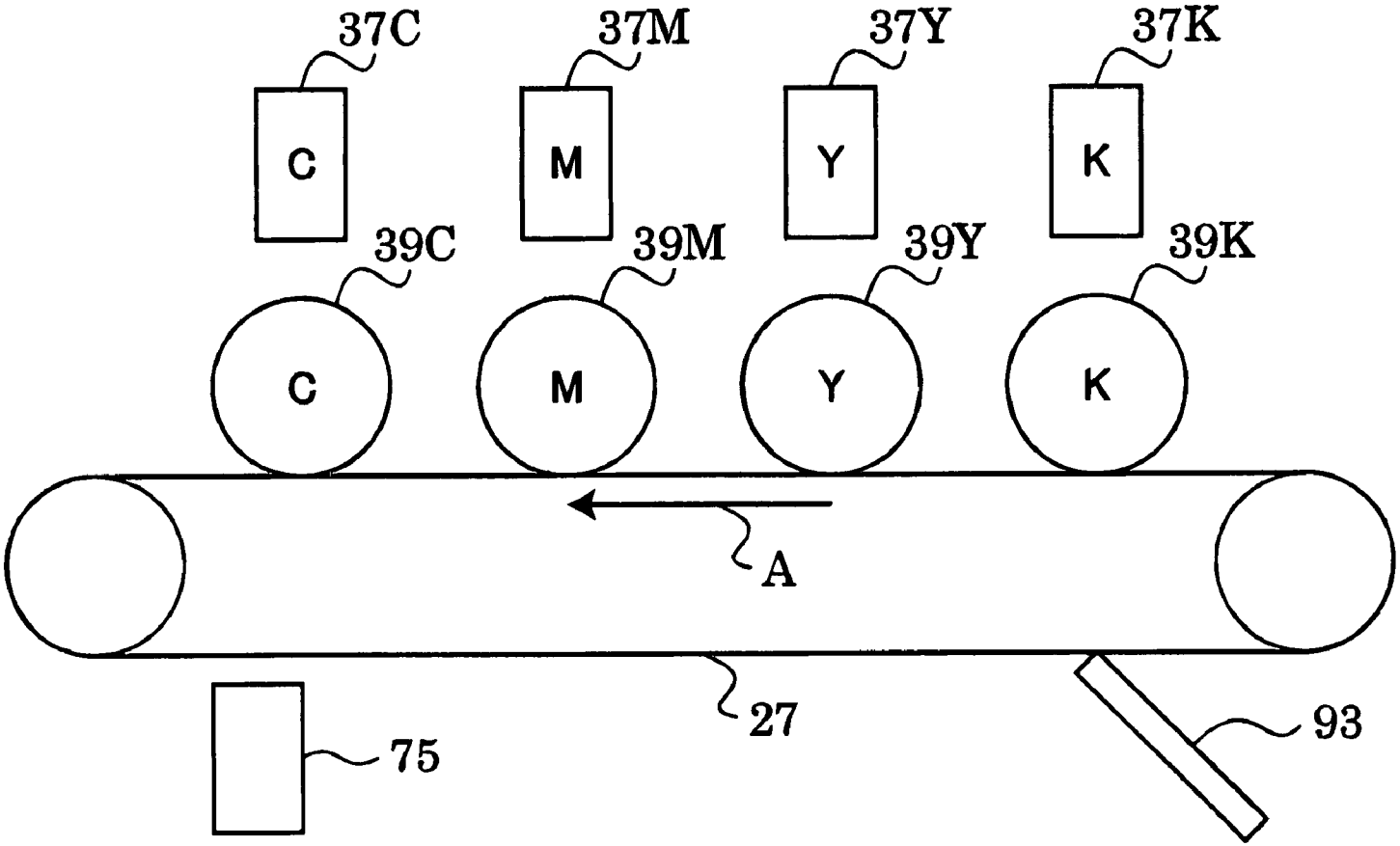
FIG. 4 is a schematic sectional view showing a main portion of the printer according to the first embodiment of the present invention.
Figure 5:
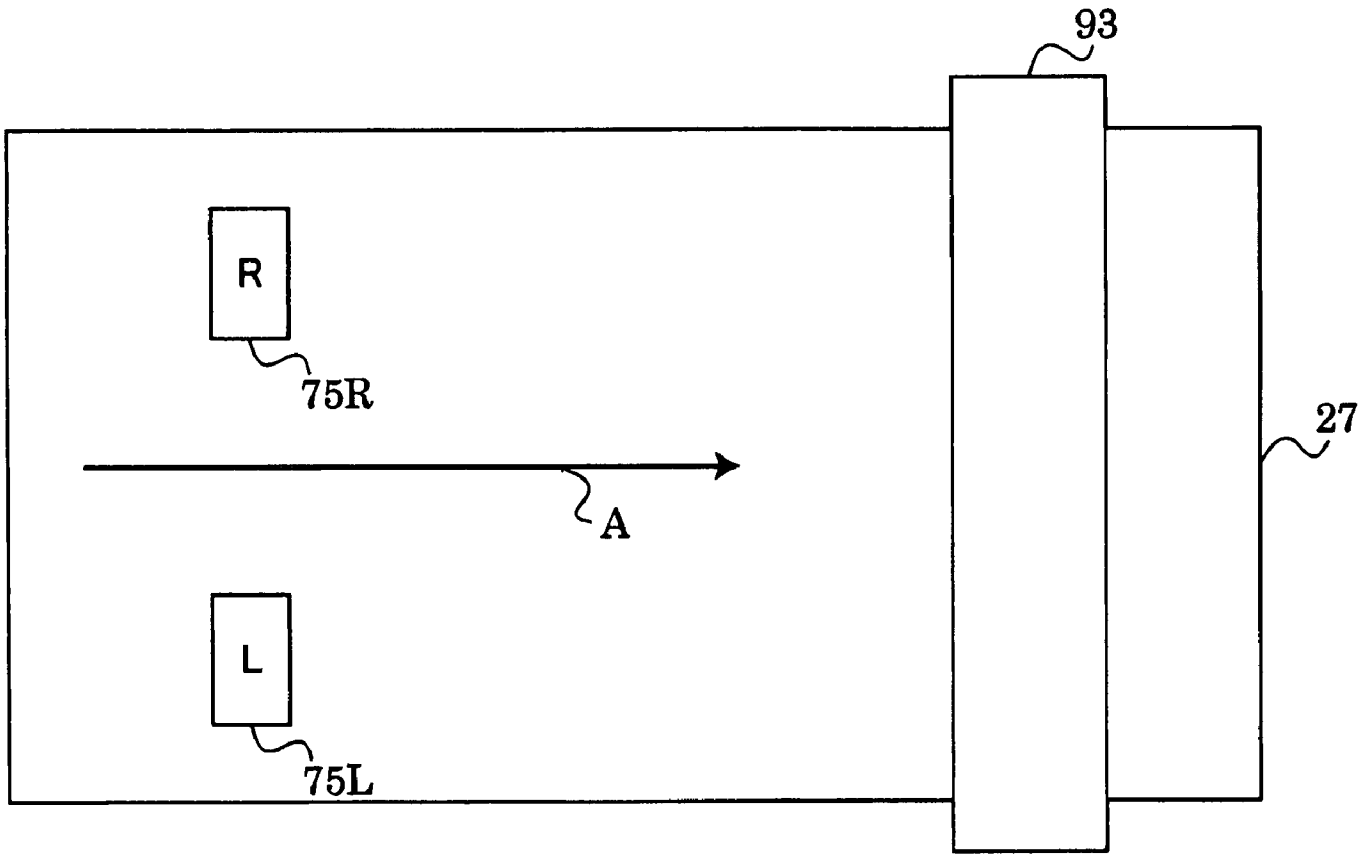
FIG. 5 is a schematic plan view showing the main portion of the printer according to the first embodiment of the present invention.

As shown in FIG. 4, the pattern detecting sensor 75 is arranged at a position proximity to the downstream side of the developing unit 23 in the driving direction A of the conveyor belt 27. The detection sensor 75 includes two pattern detecting sensors 75R and 75L, and the pattern sensor 75 is disposed in proximity of one end of the conveyor belt 27. A test pattern formed on the conveyor belt 27 is scraped off with a cleaning member 93.

Figure 6:
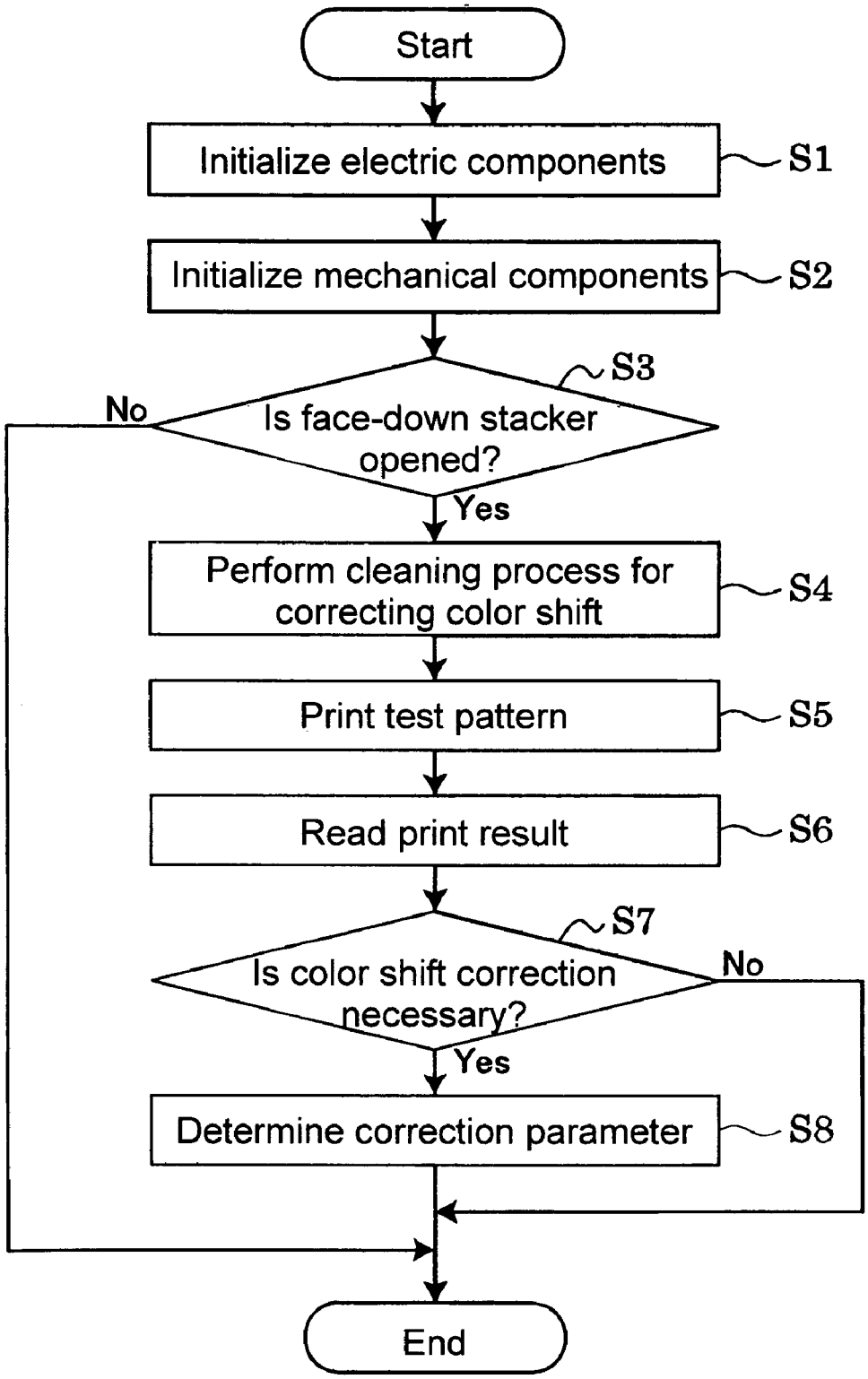
FIG. 6 is a flow chart showing an operation of the printer according to the first embodiment of the present invention.

Next, an operation of the printer 1 will be fully described referring to FIG. 6.

In Step S1, when a user turns on the printer 1 and a series of process is started, the printer 1 initializes the electric components. More specifically, the power source 79 supplies power to the control unit 51, so that the control unit 51 initializes the CPU, main memory, ASIC (application Specific Integrated Circuit), and the likes, i.e., main components of the printer 1. In Step S2, the printer 1 initializes the mechanical components. More specifically, the mechanism control unit 55 initializes the devices connected thereto.

In Step S3, the printer 1 determines whether the face-down stacker 35 is opened while the power is off. An operation of determining whether the face-down stacker 35 is opened will be described in detail.

First, an operation of the printer 1 where the face-down stacker 35 is not opened while the printer 1 is turned off will be described in detail. In the description below, it is assumed that an electric charge C is accumulated in the capacitor 85 through a voltage output from a terminal Vcc while the printer 1 is turned on.

Figure 7:
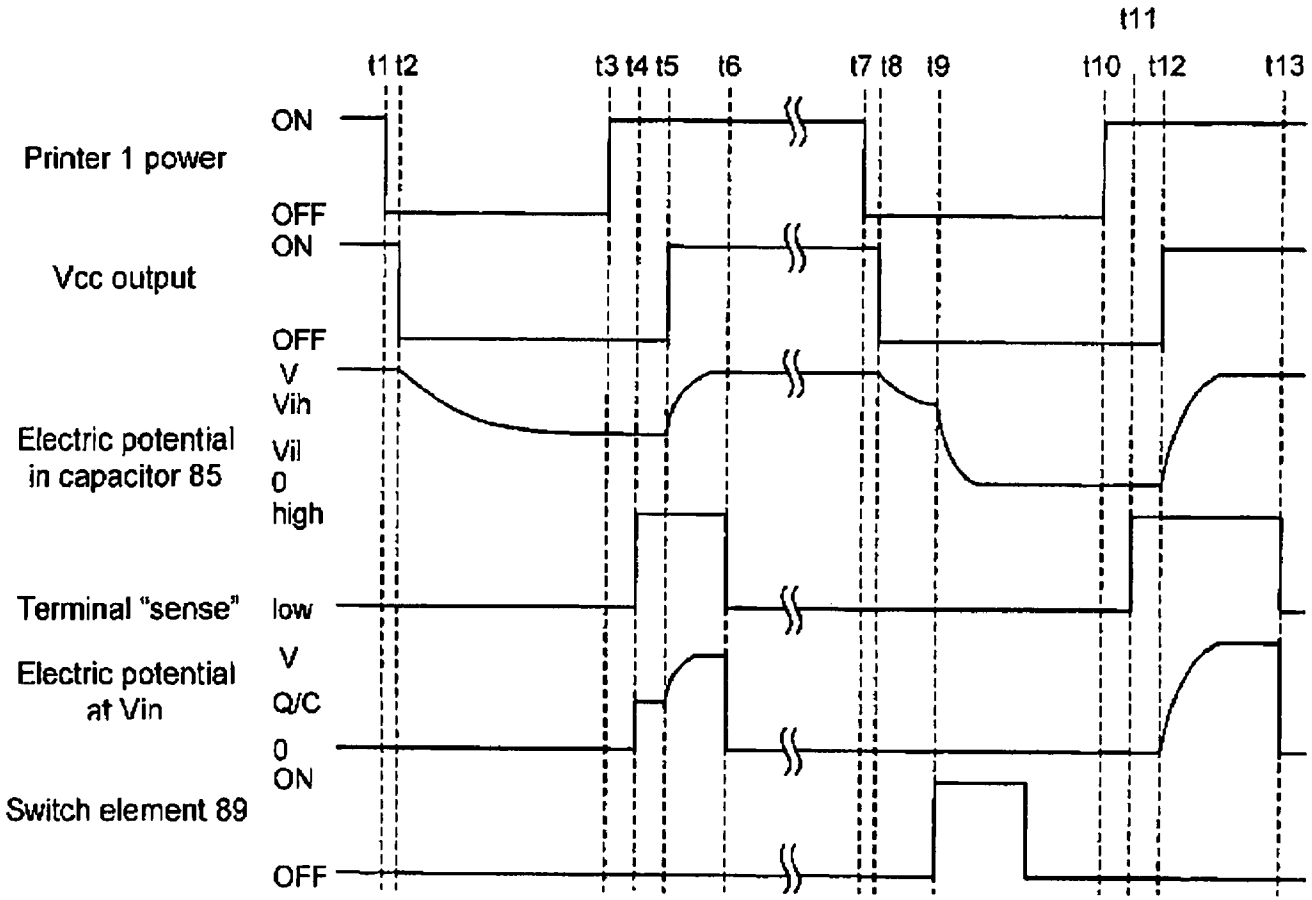
FIG. 7 is a time chart showing the operation of the printer according to the first embodiment of the present invention.

FIG. 7 is a time chart showing the operation of the printer 1 according to the first embodiment of the present invention. As shown in FIG. 7, when the printer 1 becomes from the power-on state to the power-off state at time t1, the cover open/close detecting unit 81 to the capacitor 85 stops the Vcc output to the capacitor 85 at time t2, thereby stopping power supply to the capacitor 85. Accordingly, the electric potential of the capacitor 85 gradually decreases at time t2.

At time t3, the face-down stacker 35 is not opened and the electric charge in the capacitor 85 is below the lower threshold Vil. When the printer 1 is turned on at time t3, the cover open/close detecting unit 81 recognizes at time t4 that an output of the terminal "sence" is at a high level, and electrically connects the both terminals of the FET 83. Accordingly, a voltage Q/C associated with the electric charge C stored in the capacitor 85 flows in the terminal Vin.

At time t5, the cover open/close detecting unit 81 starts supplying the voltage to the capacitor 85 again. When the cover open/close detecting unit 81 starts supplying the voltage to the capacitor 85, the electric potential of the capacitor 85 gradually increases. When the electric potential of the capacitor 85 increases, the electric potential at the terminal Vin also increases.

According to the increase in the electric potential at the terminal Vin, the printer 1 determines whether the face-down stacker 35 is opened while the printer 1 is turned off, or the printer 1 is turned off for a long period of time. At time t6, the printer 1 shifts the output of the terminal "sence" to a low level, thereby turning off the FET 83.

Next, a series of an operation of the printer 1 where the face-down stacker 35 is opened while the printer is turned off will be described in detail. When the printer 1 is turned off at time t7, the Vcc output becomes off at time t8. When the Vcc output becomes off, the electric potential of the capacitor 85 gradually decreases. When the face-down stacker 35 is opened at time t9, in response to the opening of the face-down stacker 35, the switch element 89 is turned on. When the switch element 89 is turned on, the electrical charge C stored in the capacitor 85 flows toward ground, and sharply drops.

At time t10, the printer 1 is turned on. At time t11, the output of the terminal "sence" shifts to the high level, and the FET 83 is turned on. At this moment, the electric potential C of the capacitor 85 drops to substantially zero, so that the electric potential detected at the terminal Vin is substantially zero. At time t12, when the power supply is started from the terminal Vcc to the capacitor 85, the electric potential C of the capacitor 85 increases and the electric potential detected at the terminal Vin also increases. When the electric potential at the terminal Vin increases, the printer 1 determines that the face-down stacker 35 is opened while the printer 1 is turned off or the printer 1 is turned off for a substantial amount of time, thereby performing the correction process.

As described above, the printer 1 determines whether the face-down stacker 35 is opened while the printer 1 is turned off or the printer 1 is turned off for a substantial amount of time according to the amount of the electrical charge C stored in the capacitor 85. As an example, it is assumed that the lower threshold Vil is set to 0.1 V and the upper threshold Vih is set to 0.9. When the voltage Q/C is below the lower threshold Vil, i.e. it is detected that the electric potential at the terminal Vin increases from the lower threshold Vil and exceeds the upper threshold Vih, the printer 1 determines that the face-down stacker 35 is opened while the printer 1 is turned off or the printer 1 is turned off for a substantial amount of time, thereby performing the correction process.

When the printer 1 determines that the cover is not opened while the printer 1 is turned off according to the increase in the electric potential at the terminal Vin, the printer 1 completes the series of process, and shifts to a standby mode until the print data are input.

In step S4, when the printer determines that the cover is opened while the printer 1 is turned off, the cleaning process is performed for correcting color shift. In the cleaning process, the mechanism control unit 55 applies a high-voltage to the photosensitive drum 39, so that the photosensitive drum 39 is cleaned. More specifically, the mechanism control unit 55 drives the drum motor 69 and the belt drive motor 71 via the motor driver 61. Then, the mechanism control unit 55 applies the high-voltage to the photosensitive drum 39 from the high-voltage circuit 59.

In Step S5, the printer 1 prints a test pattern. In the step, the image forming unit 57 forms a latent image of the test pattern and a developer image based on the latent image on the photosensitive drum 39. Then, the developer image is transferred to the conveyor belt 27. When the test pattern is printed, the developer images in black, yellow, magenta, and cyan are overlapped with each other with the test pattern in black as a standard.

In Step S6, the printer 1 reads a print result. In the step, the mechanism control unit 55 drives the pattern detecting sensor 75, so that the pattern detection sensor 75 measures an absorbance of the test pattern. In Step S7, the printer 1 determines whether the color shift correction is necessary. When it is determined that the color shift correction is not necessary, the printer 1 completes the series of the process.

In Step S8, when the printer 1 determines that the color drift correction is necessary, the printer 1 determines a correction parameter. In the step, the detection result of the pattern detecting sensor 75 is compared with a reference value set in advance, and the correction parameter is determined based on a comparison result. Thereafter, the printer 1 completes the series of the process.

As described above, in the embodiment, the printer 1 determines whether the face-down stacker 35 is opened or closed while the printer 1 is turned off based on the state of the capacitor 85. Therefore, the printer 1 can determine whether a consumable supply is replaced while the printer 1 is turned off. Accordingly, it is possible to omit an unnecessary correction process, thereby improving convenience for the user.

Second Embodiment

A second embodiment of the present invention will be described next. In the second embodiment, a printer 101 includes components similar to the printer 1 in the first embodiment, and explanations thereof are omitted. Only difference from the first embodiment will be described below.

Figure 8:
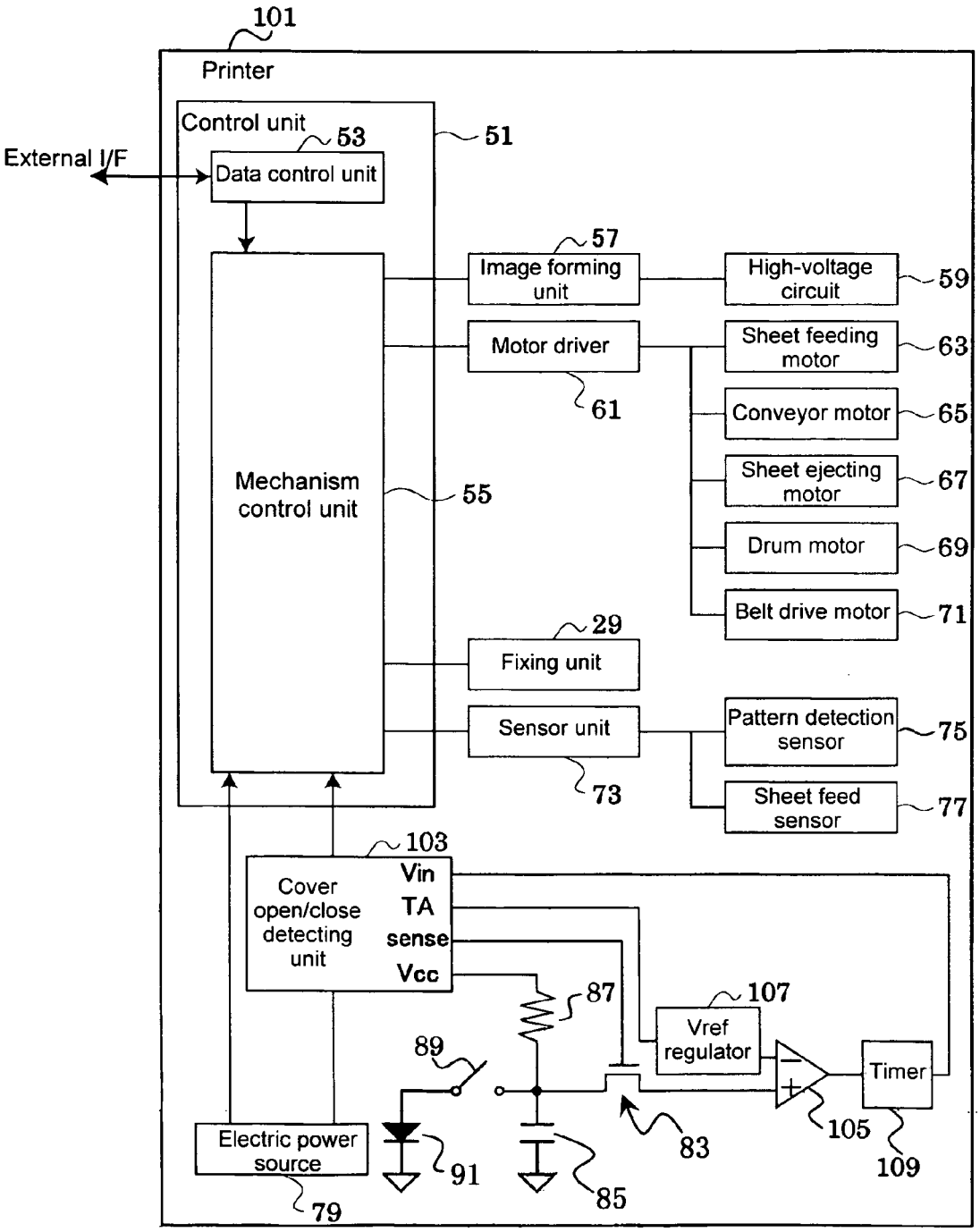
FIG. 8 is a block diagram showing a printer according to a second embodiment of the present invention.

FIG. 8 is a block diagram showing the printer 101 according to the second embodiment of the present invention. As shown in FIG. 8, the printer 101 includes a cover open/close detecting unit 103; a comparator 105 connected to a FET 83; a Vref regulator 107 to input a threshold value from the cover open/close detecting unit 103; and a timer 109 connected to an output terminal of the comparator 105.

In the embodiment, the cover open/close detecting unit 103 detects a level of the energy stored in the capacitor 85 via the FET 83, so that the cover open/close detecting unit 103 determines whether the face-down stacker 35 is opened or closed while the printer 101 is turned off. The cover open/close detecting unit 103 is connected to an output terminal of the timer 109 via a terminal Vin. In addition, the cover open/close detecting unit 103 is connected to the Vref regulator 107 via a terminal TA.

Furthermore, the Vref regulator 107 inputs the lower threshold Vil or the upper threshold Vih in an inverting input terminal of the comparator 105 according to a signal input from the terminal TA. Then, the comparator 105 compares the electric potential of the capacitor 85 input to a non-inverting input terminal with the lower threshold Vil or the upper threshold Vih input from the Vref regulator 107, and inputs a comparison result in the timer 109.

More specifically, when the electric potential of the capacitor 85 input in the non-inversing input terminal is higher than the value input in the non-inversing input terminal, the comparator 105 inputs a high-level signal in the cover open/close detecting unit 103 via the timer 109. On the other hand, where the electric potential of the capacitor 85, when the electric potential of the capacitor 85 input in the non-inversing input terminal is lower than the value input in the non-inversing input terminal, the comparator 105 inputs a low-level signal in the cover open/close detecting unit 103 via the timer 109.

The timer 109 measures an elapsed time based on the output signal from the comparator 105. More specifically, the timer 109 measures a time length from when the low-level signal is input from the comparator 105 until the output value turns to the high level signal. A time measurement result of the timer 109 is input in the cover open/close detecting unit 103.

Figure 9:
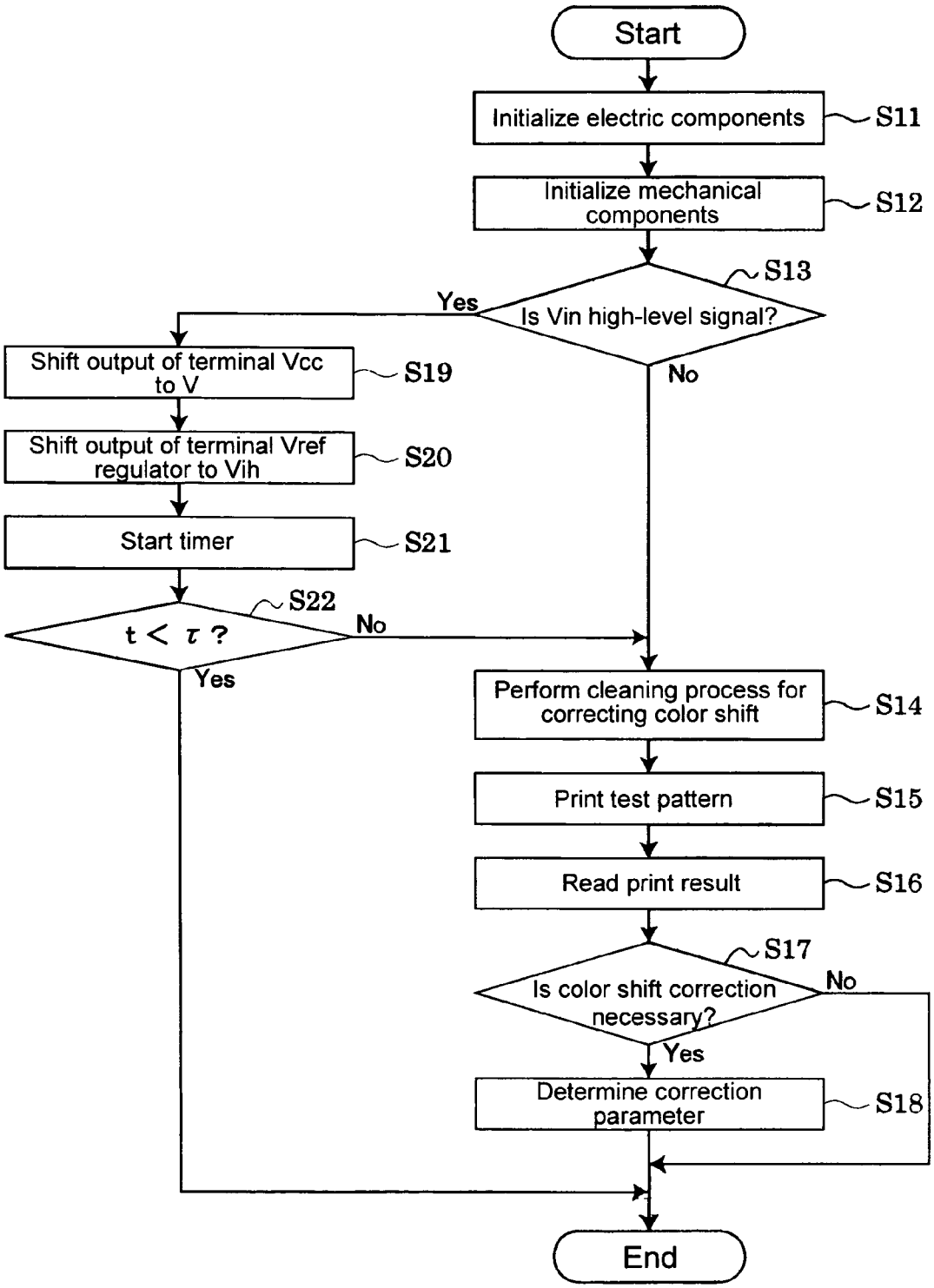
FIG. 9 is a flow chart showing an operation of the printer according to the second embodiment of the present invention.

An operation of the printer 101 will be described in detail referring to FIG. 9. FIG. 9 is a flow chart showing the operation of the printer 101 according to the second embodiment of the present invention.

In Step S11, when the printer 101 is turned on and the series of operation starts, the printer 101 initializes the electrical components. In step S12, the printer 101 initializes the mechanical components. In Step 13, the printer 101 determines whether the signal input in the terminal Vin is the high-level signal.

As described above, when the face-down stacker 35 is opened, the electric energy stored in the capacitor 85 flows to ground, so that the electric energy becomes substantially zero. When the voltage input at the terminal Vin is higher than the lower threshold Vil, it is determined that the face-down stacker 35 is not opened. The cover open/close detecting unit 103 changes the output of the Vref regulator 107 to the lower threshold Vil, and it is determined whether the output signal from the comparator 105 is the high-level signal.

When the signal input to the terminal Vin is a low-level signal, the electric potential of the capacitor 85 is lower than the lower threshold Vil. Accordingly, it is determined that the face-down stacker 35 is opened, and the printer 101 performs the process from Step 14 through Step 18, similarly to Step S4 through Step 8.

When the signal input at the terminal Vin is the high-level signal, the printer 101 determines that the face-down stacker 35 is not opened, thereby proceeding to step S19. In Step S19, the printer 101 shifts the output of the terminal Vcc to a voltage V. Accordingly, the power supply to the capacitor 85 is started. In Step S20, the printer 101 shifts the output of the Vref regulator 107 to the upper threshold Vih. In Step 21, the printer 101 starts the timer 109.

Accordingly, when the electric potential of the capacitor 85 is lower than the upper threshold Vih, the low-level signal is input to the cover open/close detecting unit 103. When the electric potential of the capacitor 85 is higher than the upper threshold Vih, the high-level signal is input to the cover open/close detecting unit 103. When the timer 109 starts at the above-described timing, it is possible to measure the time required for the electric potential of the capacitor 85 to exceed the upper threshold Vih.

In Step 22, the printer 101 determines whether the time required for the electric potential of the capacitor 85 to exceed the upper threshold Vih is smaller than a time constant $\tau$. The time constant $\tau$ indicates a time required for increasing the electric potential of the capacitor 85 from 0 V to a voltage V. The time constant $\tau$ is stored in advance according to a capacity of the capacitor 85.

Figure 10:
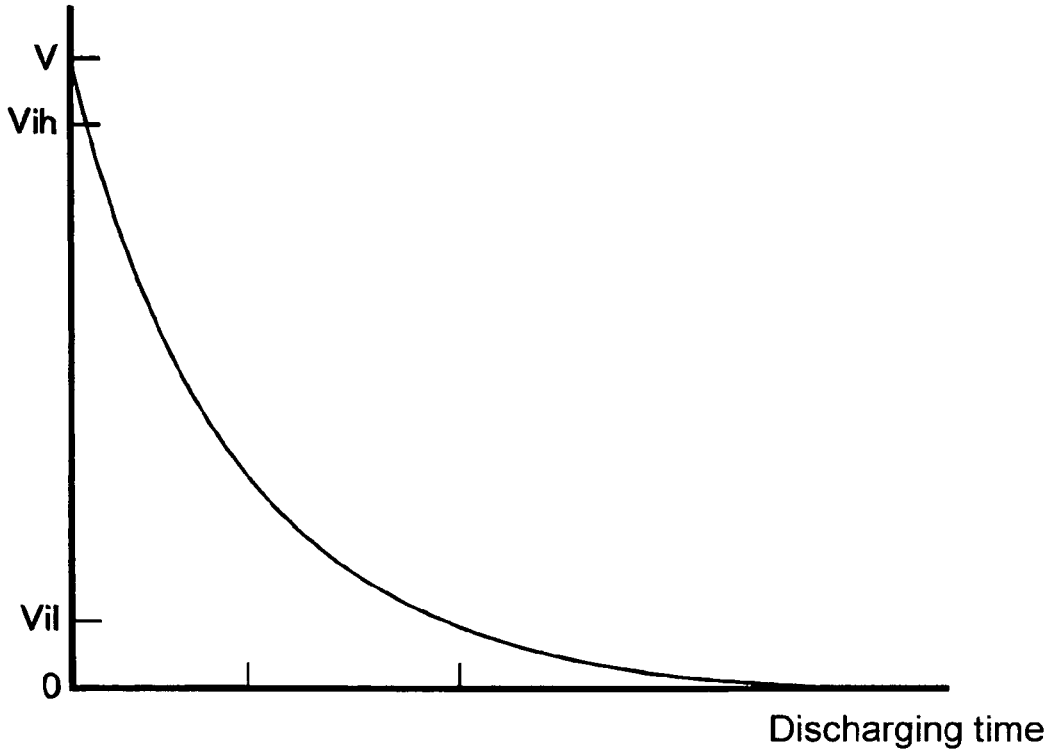
FIG. 10 is a graph showing a change in a potential of a capacitor of the printer according to the second embodiment of the present invention.

FIG. 10 is a graph showing a change in the potential of the capacitor 85 of the printer 101 according to the second embodiment of the present invention. As shown in FIG. 10, the potential of the capacitor 85 is discharged with time. Accordingly, from a relation between a time t and the time constant $\tau$, it is possible to calculate a time length during which the printer 101 is turned off.

That is, when the time t is larger than the time constant $\tau$, the printer 101 is turned off for a long period time, and the printer 101 performs the correction process from Step S14. On the other hand, when the time t is smaller than the time constant $\tau$, the discharge of the capacitor 85 is small. Accordingly, it is determined that the printer 101 is not turned off for a long period time. Accordingly, the printer 101 completes the series of process without the correction process.

As described above, in the embodiment, in addition to the above-described effects, it is possible to determine the time during which the printer 101 is turned off. When the printer

101 is turned off in a short period of time, it is possible to omit the correction process upon turning on the printer 101, thereby shortening the start-up time and improving convenience for the user.

The invention is not limited to the above embodiments, and can be optionally modified within scope of the invention. For example, the time constant $\tau$ is set based on the time for charging the capacitor 85, and the time constant $\tau$ may be set based on an amount of the charge in the capacitor 85 when the printer 101 is turned off.

In the first embodiment, it is determined whether the printer 1 is left or the face-down stacker 35 is opened according to the increase in the electric potential of the capacitor 85 from before the Vc output is turned on relative to the capacitor 85 to after the Vc output is turned on relative to the capacitor 85 when the printer 1 is turned on. Alternatively, it is possible to determine whether the electric potential of the capacitor 85 is lower than the lower threshold Vil before the Vcc output is turned on relative to the capacitor 85 upon turning on the printer 1. When the electric potential of the capacitor 85 is lower than the lower threshold Vil, the correction process is performed.

The disclosure of Japanese Patent Application No. 2007-224010, filed on Aug. 30, 2007, is incorporated in the application.

While the invention has been explained with reference to the specific embodiments of the invention, the explanation is illustrative and the invention is limited only by the appended claims.

What is claimed is:

1. An image forming apparatus comprising:

an image forming unit for forming an image;

a cover;

an accumulation unit capable of accumulating energy, said accumulation unit having a specific time constant;

an initializing unit for initializing a level of the energy accumulated in the accumulation unit when the cover is opened;

a threshold regulating unit for outputting a first threshold value relative to the level of the energy and a second threshold value smaller than the first threshold value and greater than zero;

a comparison unit having a first input terminal for inputting the first threshold value or the second threshold value and a second input terminal for inputting the level of the energy, said comparison unit being arranged to output a first output signal when the level of the energy is smaller than the second threshold value, said comparison unit being configured to output a second output signal when the level of the energy is greater than the second threshold value, a detection unit for detecting the first output signal and the second output signal to determine whether the level of the energy accumulated in the accumulation unit is initialized, said accumulation unit being arranged to start accumulating energy in the accumulation unit when the detection unit detects the second output signal after the image forming apparatus is turned on;

a timing unit for measuring a period of time from when the accumulation unit starts accumulating energy to when a level of energy reaches the first threshold value;

a state correction unit for correcting a state of the image forming unit according to a detection result of the detection unit and the period of time measured with the timing unit, said state correction unit being arranged to correct the state of the image forming apparatus when the period of time is greater than the time constant, said state correction unit being arranged to not correct the state of the image forming apparatus when the period of time is smaller than the time constant.

2. The image forming apparatus according to claim 1, wherein said accumulation unit includes a charge accumulation member for accumulating a charge and releasing the charge through a self-discharge process, said initializing unit including a discharge member for discharging the charge.

3. The image forming apparatus according to claim 2, wherein said charge accumulation member is formed of a capacitor, and said discharge member is formed of a switch element.

4. The image forming apparatus according to claim 1, wherein said state correction unit is arranged to correct the state of the image forming unit when the detection unit detects the first output signal.

* * * * *